United States Patent [19]

Twina

[11] Patent Number: 4,567,825

[45] Date of Patent: Feb. 4, 1986

[54] APPARATUS FOR IMPRINTING DETAILS APPEARING ON A CREDIT CARD ONTO PAPER SHEETS

[76] Inventor: Yeheskel Twina, 3,Yeheskel St., Ramath Gan, Israel

[21] Appl. No.: 595,700

[22] Filed: Apr. 2, 1984

[30] Foreign Application Priority Data

Apr. 12, 1983 [IL] Israel ..... 68291

[51] Int. Cl.[4] ..... B41F 3/04

[52] U.S. Cl. ..... 101/269

[58] Field of Search ..... 101/269, 283, 284, 285, 101/286

[56] References Cited

U.S. PATENT DOCUMENTS

| | | | |
|---|---|---|---|
| 3,388,660 | 6/1968 | Wight | 101/269 |
| 3,447,458 | 6/1969 | Hu | 101/269 |
| 3,656,429 | 4/1972 | Bradford et al. | 101/269 |
| 3,954,056 | 5/1976 | Barbour | 101/269 |
| 4,027,589 | 6/1977 | Timm | 101/269 |

*Primary Examiner*—Edgar S. Burr
*Assistant Examiner*—John A. Weresh
*Attorney, Agent, or Firm*—Fleit, Jacobson, Cohn & Price

[57] ABSTRACT

An apparatus for imprinting details contained in embossed script on a credit card onto a purchase document comprises a base member of ⊔-profile in which a movable member including a pressure roller moves on castors. Lateral slots in the two walls of the base member permit the introduction—at one side of the base member—of a credit card, and of papers at the opposite side of the base member. The said movable member can be actuated by a handle pivotally attached to the base and connected by a connecting rod with the said movable member.

3 Claims, 4 Drawing Figures

APPARATUS FOR IMPRINTING DETAILS APPEARING ON A CREDIT CARD ONTO PAPER SHEETS

FIELD OF THE INVENTION

The present invention concerns an apparatus for transferring details from a credit card and details of a seller (which term includes also servicing establishments) onto a "document of purchase". Such a document conventionally comprises three copies, all of which must have imprinted thereon the above mentioned details.

BACKGROUND OF THE INVENTION

As it is well known, the use of credit cards is increasing all over the world. The card is made of rigid plastic bearing the particulars of the holder, such as his name, the number of his bank account and any other details as needed. All these details have to be transferred onto a special document which must be signed by the purchaser. To achieve this necessity, conventionally a simple device is used which comprises a plate part on which a roller can be moved to and fro. The credit card is placed on the plate part. On top of the card the desired copies of the document of purchase with interleaved carbon paper sheets is placed, and the roller is moved—possibly repeatedly—over the document in both directions. Due to the embossed letters on the credit card and due to the pressure applied on the card by the roller, all the details are transferred to the document and its copies.

The known devices, which are more or less of the same construction as described, apply great pressure on the document thus tearing, folding or crumpling the document. Moreover, due to the great friction of the roller, the apparatus is subject to considerable wear and tear. The operation of the known devices is also cumbersone, difficult and inconvenient.

OBJECTS OF THE INVENTION

It is an object of the present invention to provide an apparatus which will overcome the disadvantages of the known devices.

It is another object of the invention to provide the apparatus with means by which to release the pressure on the roller on its movement in one direction.

It is yet another object of the invention to provide the roller mechanism with roller bearings to ease the movement of the roller.

It is a further object of the invention to provide means of orientation for the credit card and for the document of purchase so as to enable easy introduction into the apparatus of same.

Yet another object of this invention is to provide an apparatus which will be operated manually by means of a handle to one direction and which will revert to its starting position by a spring or like means.

SHORT SUMMARY OF THE INVENTION

The invention is characterised by comprising two main parts, namely a ⊔-profiled base member which has a slot on each side thereof and a second part in which is journalled a roller, such second part being adapted to move within the said ⊔-shaped member, said moving second part being provided with means which apply and release pressure on the roller.

SHORT DESCRIPTION OF DRAWINGS

The invention will now be described in detail referring to the annexed drawings in which:

FIG. 1 is a perspective view of the apparatus, while

DESCRIPTION OF PREFERRED EMBODIMENT

Figure 2:
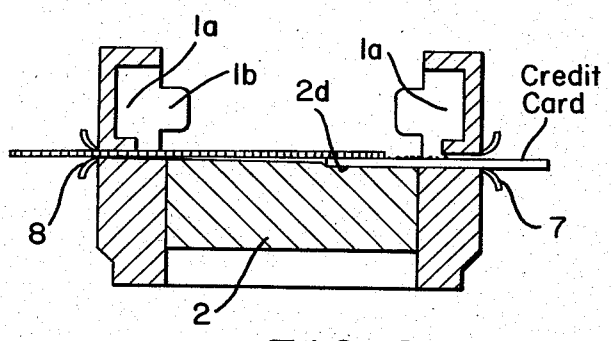
FIG. 2 is a cross sectional view along line II—II of FIG. 1.
Figure 1A:
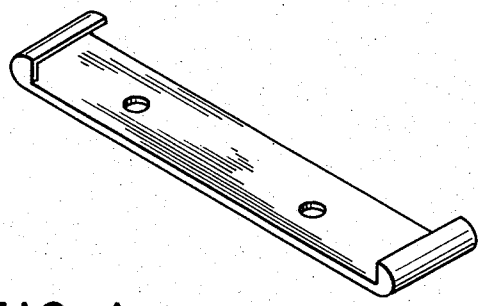
FIG. 1*a* is a part thereof.
Figure 1:
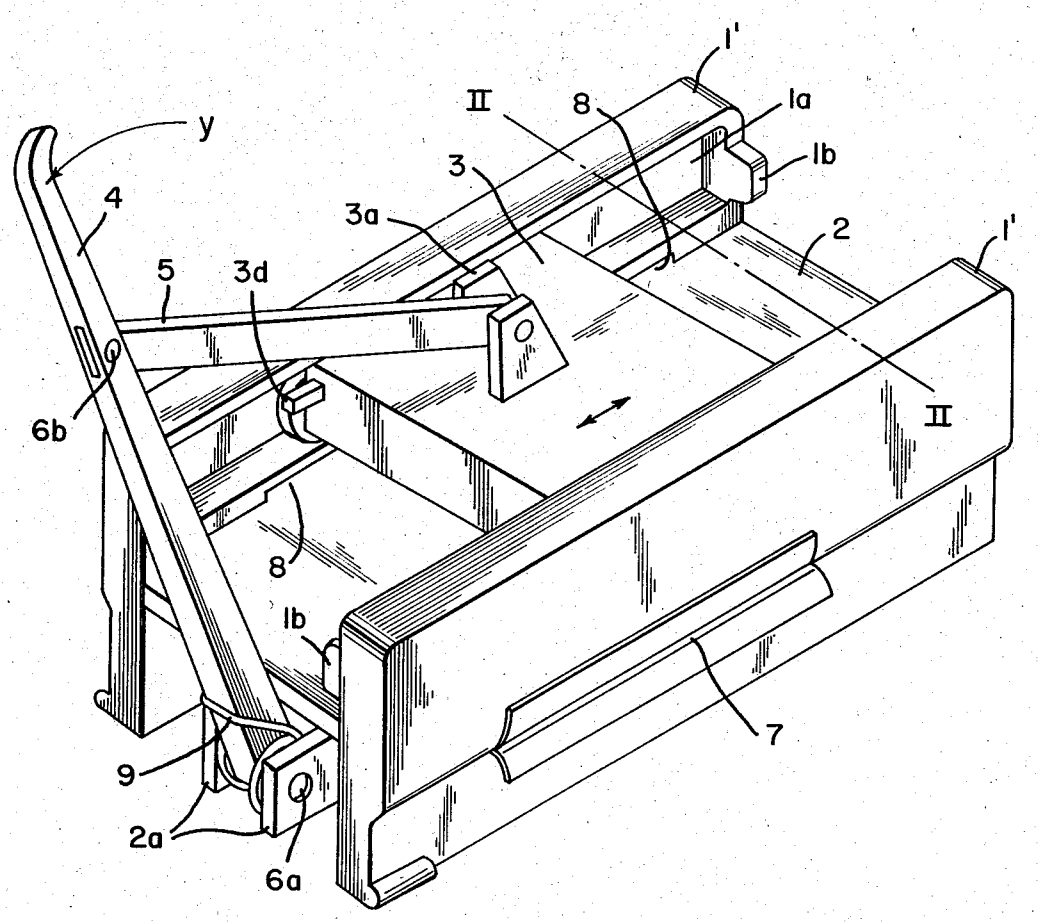
Figure 3:
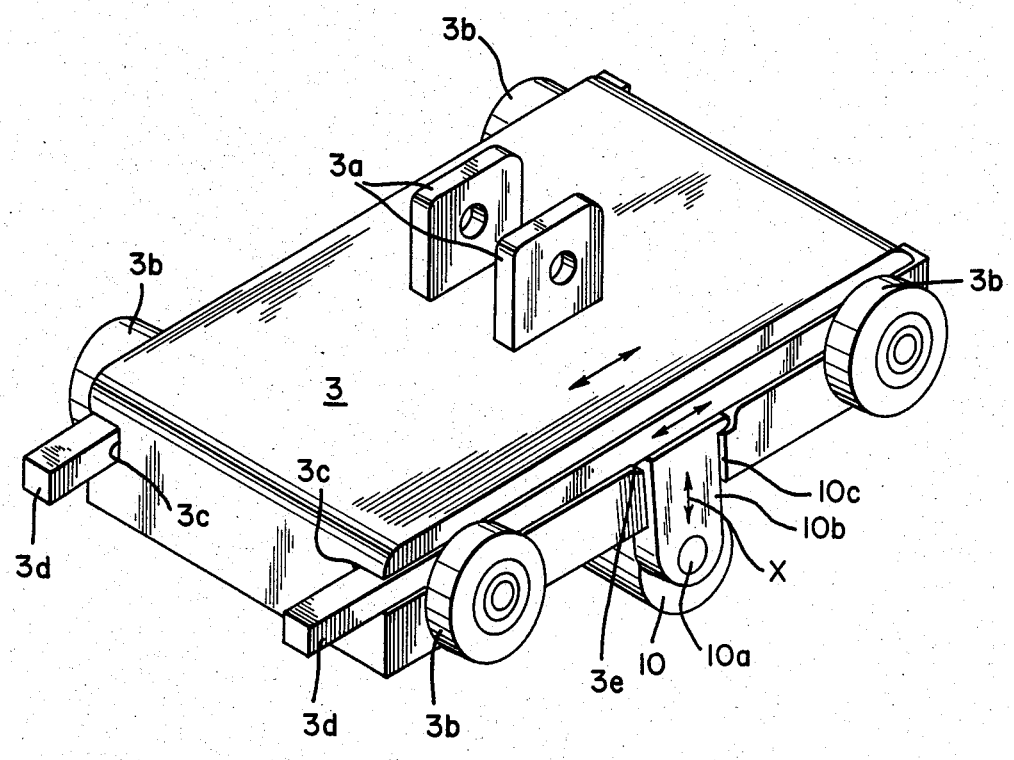
FIG. 3 is a perspective view of the moving part of the apparatus.

Turning first to FIG. 1, the apparatus comprises a base part designated as a whole by the reference numeral 1. This part consists of two oppositely disposed walls 1' between which extends a plate 2, thus forming together a ⊔-profile. The said walls are provided at their sides which face one another with recesses 1*a*, the ends of which are closed by tongues 1*b*. In said two walls there are provided slots 7 and 8 and being passages to a plate member 2, at one end of which there are provided ears 2*a* inbetween which an operating handle 4 is pivotally held. Handle 4 swings about a pin passing through holes 6*a* in ears 2*a* onto which pin a spring 9 is wound, as shown in FIG. 1, urging the handle 4 into "idle" position. Handle 4 is linked to a connecting rod 5 which is at one end pivotally connected to said handle by means of pin 6*b* while its other end is pivotally connected to a pin extending between two ears 3*a* which fixedly extend from the moving part 3 of the apparatus.

The second part 3 is a rectangular prismatic body which is provided with four castors 3*b* on which it moves inbetween the two walls 1'. The body 3 has two lateral slots 3*c* in which two square profiled beams 3*d* are placed. The beams 3*d* are of differing width and thickness at two parts of their extension, thus have at about their middle, shoulders 3*e*. They can move within the slot. The main roller 10 (which applies the pressure onto the document) rotates about axis 10*a* being journalled at both ends in two members 10*b*, which are positioned in grooves 10*c*, thus being able to move "up" and "down" as indicated by arrow X.

The apparatus functions in the following manner. The credit card is introduced into slot 7 and the document of purchase is introduced at the opposite side into slot 8. Due to the fact that the credit card is slipped into a guiding and orientating recess 2*d* which is provided in member 2, the document, on being inserted, will ride over the credit card. The handle 4 is now moved in the direction of arrow Y, and as the handle is connected to the moving part 3 via rod 5 it travels on its castors within grooves 1*a*. Roller 10 rolls over the document and the card underneath it while applying pressure on it. At the end of its path, the two beams 3*d* abut against tongues 1*b*, causing the beams to move in the opposite direction within the slots 3*c*, and the beams ride over members 10*b* which are urged towards the beams. As has been stated, the beams are divided into two parts, one of which is narrower than the other. When the narrow part reaches member 10*b* it permits an "up" movement of member 10*b* thus releasing the pressure of roller 10 held inbetween, and as a consequence the return movement of part 3 to the idle position is easy, without friction.

It will easily be understood—and experience has confirmed this—that with the use of the new apparatus credit cards and the purchase document relating to a certain transaction can be processed by a salesperson quickly and conveniently without tearing, crumpling or otherwise damaging papers, and obtain clearly legible imprints on the purchase document.

The two main parts of the apparatus, i.e. the base part and the moving part can be made of plastics by injection moulding.

The part shown in FIG. 1*a* is a bracket which can be affixed to a wall whereupon the apparatus—being slid into the bracket—will be held therein and will be ready for use.

I claim:

1. An apparatus for imprinting details appearing on a credit card onto paper sheets, such apparatus comprising:

(a) a U-profiled base member having a bottom wall and two spaced, oppositely disposed side walls extending from said bottom wall, said base member including abutment means adjacent opposite ends of said side walls and (b) a second member having a presser roller, which second member is movable between said abutment means in the space defined by the oppositely disposed walls of the U-profiled base member and said roller is movable along the bottom wall thereof about an axis of rotation, the said base member having a slot in each of the said two oppositely disposed side walls thereof, the said second member having the said presser roller journalled in between two oppositely disposed slidable roller carrier members carried in the said second member and movable perpendicularly toward and away from the bottom wall of the base member, with the axis of the roller extending across the direction of movement of the second member, and handle means connected to said second member for moving the said second member, said second member including a slot in each opposite side thereof and an elongated beam member extending from and slidably carried in each slot and adapted to contact said abutment means, said beam members having a first cross-sectional area at a first longitudinal position and a second cross-sectional area at a second longitudinal position, said second cross-sectional area being greater than said first cross section area, said beam members positioned adjacent said slidable roller carrier members and movable in a longitudinal direction perpendicular to the direction of movement of said slidable roller carrier members to alternately cause said first and said second cross-sectional areas of each beam member to be adjacent said slidable roller carrier members to permit said slidable roller carrier members to move away from said base member when said first cross-sectional areas are adjacent the slidable roller carrier members and to prevent said slidable roller carrier members from moving away from said base member when said second cross-sectional areas are adjacent the slidable roller carrier member, wherein movement of said second member along said U-profiled base member in one direction causes the beam members to strike one of said abutment means to cause the beam members to slide within said slots in the direction opposite to the direction of movement of said second member immediately before said beam members strike the abutments, with the first cross-sectional areas of the beam members opposite the slidable roller carrier members in which the roller is journalled, thus permitting movement of the slidable roller carrier members away from the bottom wall of the base member and releasing pressure of the roller on the underlying papers resting on the bottom wall of the U-profiled base member, and wherein movement of said second member along said U-profiled base member in an opposite direction causes the beam members to strike another abutment means to cause the beam members to slide within the slots with the second cross-sectional areas of the beam members opposite the slidable roller carrier members to prevent movement of the slidable roller carrier members away from the bottom wall of the base member.

2. The apparatus claimed in claim 1, wherein the handle means for moving the said second member include a lever-handle hingedly attached to the base member and connected with the said second member by a connecting rod hingedly attached at one of its ends to the said lever handle and at its opposite end to the said second member.

3. The apparatus claimed in claim 2, including spring means urging the said lever-handle into an idle position at one end of the path of movement of said second member after its having actuated the said second body by moving it across said base member.

* * * * *